US007102518B2

(12) United States Patent
Bellum et al.

(10) Patent No.: US 7,102,518 B2
(45) Date of Patent: Sep. 5, 2006

(54) REMOVABLE IDENTIFICATION DEVICE FOR MULTILAYER TUBULAR STRUCTURES

(75) Inventors: Cliff Bellum, Hartsville, SC (US); James Lowry, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 333 days.

(21) Appl. No.: 10/818,124

(22) Filed: Apr. 5, 2004

(65) Prior Publication Data

US 2005/0237199 A1 Oct. 27, 2005

(51) Int. Cl.
*G08B 13/14* (2006.01)

(52) U.S. Cl. ..... 340/572.1; 340/572.8; 235/462.13

(58) Field of Classification Search ..... 340/572.1, 340/572.9; 700/214; 235/462.13
See application file for complete search history.

(56) References Cited

U.S. PATENT DOCUMENTS

| | | | | |
|---|---|---|---|---|
| 5,785,181 | A | 7/1998 | Quartararo, Jr. | |
| 5,963,134 | A | 10/1999 | Bowers et al. | |
| 6,040,773 | A | 3/2000 | Vega et al. | |
| 6,104,295 | A | 8/2000 | Gaisser et al. | |
| 6,252,508 | B1 | 6/2001 | Vega et al. | |
| 6,334,587 | B1 | 1/2002 | Röder | |
| 6,478,229 | B1 | 11/2002 | Epstein | |
| 6,667,092 | B1 | 12/2003 | Brollier et al. | |
| 6,669,082 | B1 | 12/2003 | Meyer | |
| 6,696,879 | B1 | 2/2004 | Tuttle et al. | |
| 2004/0102869 | A1 * | 5/2004 | Andersen et al. | 700/215 |
| 2004/0102870 | A1 | 5/2004 | Andersen et al. | |

FOREIGN PATENT DOCUMENTS

| | | |
|---|---|---|
| DE | 202 05 555 U1 | 7/2002 |
| EP | 1595801 | 11/2005 |
| WO | WO 99/05660 | 2/1999 |
| WO | WO 99/46744 | 9/1999 |
| WO | WO 99/50788 | 10/1999 |
| WO | WO 01/18732 A2 | 3/2001 |
| WO | WO 2004/075103 | 9/2004 |

* cited by examiner

*Primary Examiner*—Phung T. Nguyen
(74) *Attorney, Agent, or Firm*—Alston & Bird LLP

(57) ABSTRACT

A multilayer tubular structure for products with an identification device is disclosed. In one embodiment, a resiliently flexible band is biased with respect to the tubular structure, and the identification device, such as a radio frequency identification device, is interposed therebetween.

26 Claims, 7 Drawing Sheets

10
11

11

30
40

30
40
30
40

30
40

12
14
16
18
20
D1
D2
D2

10
11

11

30
40
30
40

30
40

30
40

16
18
D1
20
D2
12
14

37
38
37
36
D2
30
40

30
37
38
37
40

10
11

12
14
16
18
20
D1
D2
30
32
33
34
35
36
40

REMOVABLE IDENTIFICATION DEVICE FOR MULTILAYER TUBULAR STRUCTURES

BACKGROUND OF THE INVENTION

The present invention relates to "smart packaging" systems and methods, and more particularly to electronic detection devices, such as radio frequency identification devices ("RFID" tags or devices hereinafter) and methods of using these devices in packaging and package tracking systems.

Monitoring the location and status of items is advantageous in many applications. For example, in manufacturing environments it is important to know the whereabouts of items in a factory, and in transportation environments it is important to identify and document the coming and going of items from a warehouse or the like. Bar codes have traditionally been used to identify and track items. In particular, 1D bar codes are most common and are used to identify items at the grocery store, etc. More recently, 2D bar codes have been developed and provide substantially more information than 1D bar codes. Thus, 2D bar codes are used with shipping labels and other items where more information is typically needed to identify the item(s) associated with the bar code. However, 1D and 2D bar code systems are often not compatible with one another, and the bar code must be clearly visible and readable by a scanner or the like in order to transfer the information associated with the bar code.

Another method for tracking an item and/or transferring information about an item is through a magnetic strip having pre-programmed coded information that is attached to an outer surface of an item. The information is read by passing the magnetic strip through a high-resolution magnetic reader to produce an electric field. While this technology does not require a clear line-of-sight between the reader and the strip for proper reading of the information, the distance at which the strip can be read is limited, and the system is limited to read-only. The magnetic strips are also prone to damage, which can be a problem for longer magnetic strips that contain more data.

Another way to track items is through the use of RFID. RFID has been used for some time in a variety of applications, from tracking garments to pallets to trucks. RFID works on an inductive principle. In a passive RFID system, a reader generates a magnetic field at a predetermined frequency. When a RFID tag, which can be usually categorized as being read-only or read/write, enters the magnetic field, a small electric current forms in the tag's resonant circuit, which includes a coiled antenna and a capacitor. This circuit provides power to the RFID tag, which then modulates the magnetic field in order to transmit information that is pre-programmed on the tag back to the reader at a predetermined frequency, such as 125 kHz (low frequency) or 13.56 MHz (high frequency). The reader then receives, demodulates, and decodes the signal transmission, and then sends the data onto a host computer associated with the system for further processing.

An active RFID system operates in much the same way, but in an active system the RFID tag includes its own battery, allowing the tag to transmit data and information at the touch of a button. For example, a remote control garage door opener typically uses an active RFID tag that transmits a predetermined code to the receiver in order to raise and lower the garage door at the user's discretion.

Another technology that is related to RFID tags is known as Bistatix, which operates much the same way as RFID tags except that the coiled antenna and capacitor of the RFID tags have been replaced by a printed, carbon-based material. As a result, a Bistatix tag is extremely flat and relatively flexible, although currently these types of devices are limited to a frequency range of about 125 KHz. In addition, the read range of a Bistatix tag is dependent on size, so for long read ranges a very large tag may be required. Regardless, whether a Bistatix, active, or passive RFID tag is used in a particular tracking system, these tags and systems have greatly advanced package tracking and data management.

One of the challenges that exist with electronic detection devices, and with RFID systems in particular, is how to apply a RFID tag to an item. Currently tags are glued to an outer surface of a container or pallet, and while this method is satisfactory for many applications, the prominent location of the tag often leaves the tag exposed and subject to damage or inadvertent removal during processing. Other types of tag applications include sewing tags into a garment and clipping tags to an item with metal fasteners. The difficulties in applying a detection device is particularly pronounced when applying such devices or tags to tubular rolls or containers, such as those used in supporting roll goods or for packaging food products, as these types of structures often rub against one another during production and thereby cause damage to the tags. In addition, reusable carriers or containers are often used for many cycles, such as in doffing and creeling textile yarn, which can further accelerate damage to the RFID tag. Thus, there is a need to manufacture a container or carrier having an electronic detection device that will not be damaged or destroyed during processing.

Another problem facing RFID technology is the cost associated with wasting RFID tags, particularly when used with objects with a relatively short lifespan. For example, tubular core that are used with roll goods are often made out of paperboard stock and are recycled after being damaged or worn. Conventional RFID tags that are glued to the core are destroyed when the core is recycled, even though the tag can be used for a much longer period. Thus, there is a need for an RFID tag that can be recycled when the lifespan of the object it is associated with is over.

BRIEF SUMMARY OF THE INVENTION

These and other needs are provided by the tubular structure and methods of forming the tubular structure according to the present invention. Advantageously, the tubular structure of the present invention includes a tubular core and an electronic detection or identification device, such as a radio frequency identification device or tag, which is releasably associated with the tubular core by a resiliently flexible band or sheet. The flexible band is biased against the inside of the core or about the outer surface of the core, and the detection device is interposed between the band and the core. In this manner, the detection device is protected from damage by the band, and the detection device can be removed from the core if the core is recycled or the like. In another embodiment, the detection device is attached to the flexible sheet that is itself biased against the inner surface of the core and held in place by a frictional or interference fit. The sheet and detection device can be removed when the core is recycled.

Methods of manufacturing tubular structures for storing products are also provided, wherein the resiliently flexible sheet or band is biased to form an interference fit with the tubular core. A detection device is in contact with the flexible sheet or band, and is releasably secured during the biasing step.

The tubular structure of the present invention has many uses. Because the identification device is protected by the flexible band or sheet, there is less risk of damage or breakage from being hit or bumped during processing of the products or movement of the core. In addition, the flexible band or sheet and the identification device can be removed, such as if the core is recycled. The tubular structure is particularly useful for tracking products that are stored on or therein, such as cookies, potato crisps, roll goods, and the like. The methods of the present invention do not require special construction techniques, end caps, or special grooves cut into portions of the tubular structure, all of which can decrease manufacturing efficiency and increase manufacturing costs.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
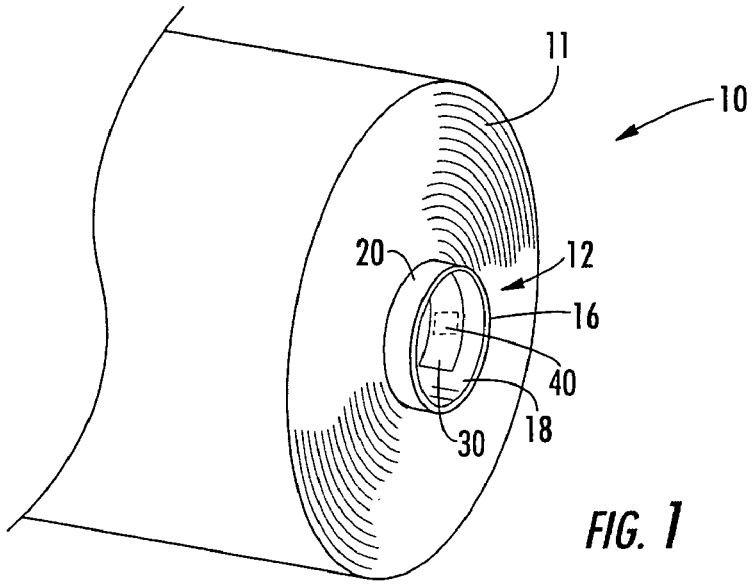
FIG. 1 is a side perspective view of a tubular structure according to one embodiment of the present invention.
Figure 2:
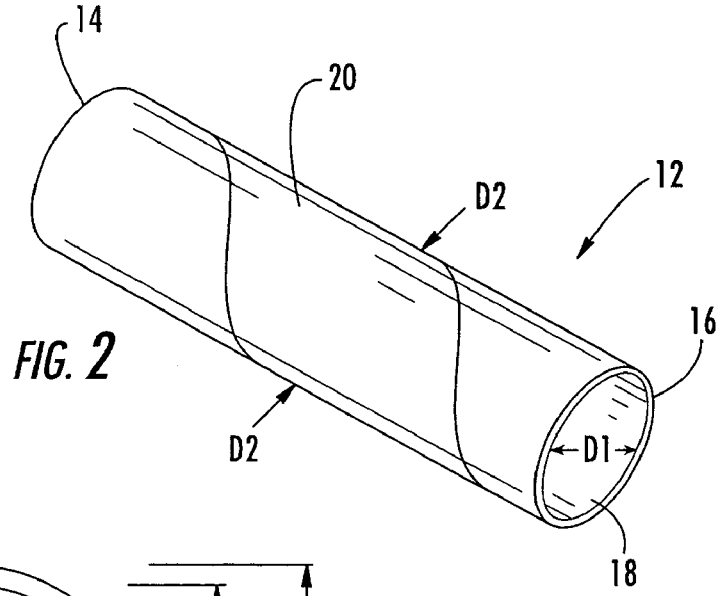
FIG. 2 is a side perspective view of a tubular core of the tubular structure shown in FIG. 1.

FIGS. 1 and 2 show a tubular structure 10 for storing goods or products 11 according to one embodiment of the present invention that comprises a tubular core 12 having inner and outer surfaces 18, 20 and opposed ends 14, 16. Such tubular bodies are used as containers for packaging products, such as cookies and potato crisps, and as winding cores for supporting products wound around the outer surface of the tube, such as textiles, paper goods, and the like (as shown in FIG. 1). The term "tubular structure" is used herein to denote both containers and winding cores, noting that the advantageous features of the present invention may exist in each type of tubular body.

In one embodiment, the tubular core 12 is formed from multiple plies or layers of flexible material, such as paperboard, wrapped one upon another about an axis of the tubular core and adhered together in a radially layered construction. The tubular core 12 can also be formed from other materials, such as plastics or composite materials. The inner surface 18 of the tubular core 12 defines an inner diameter D1, while the outer surface 20 defines an outer diameter D2. The thickness of the tubular core 12 is primarily a function of the products stored in or on the core, as well as the processing and use of the core. As such, the thickness of the core 12 may be from about 0.1 inch to about 3.0 inches, although the thickness may be greater or less than this range as desired. The length of the core 12 is also subject to the particular use of the core and the products associated therewith. Typically, containers for packaging products are about 1 foot in length, while cores used with roll goods can be up to 5 feet and longer. The features and advantages of the tubular structure 10, however, can be achieved regardless of the particular thickness and length of the core 12. FIG. 1 also shows a resiliently flexible band or sheet 30 for securing an electronic detection or identification device 40, as discussed below.

Figure 3:
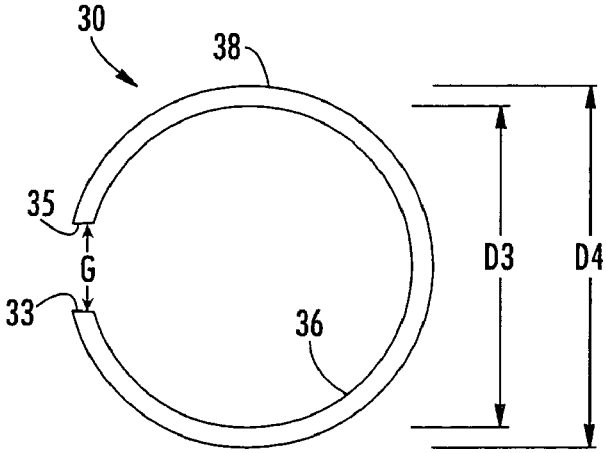
FIG. 3 is a cross-sectional view of a flexible band according to one embodiment of the present invention.

More specifically, FIG. 3 shows a resiliently flexible band or sheet 30 that is releasably secured to the core 12 in one of several ways. In particular, the band 30 has opposing side edges 33, 35 and inner and outer surfaces 36, 38. The band 30 may be formed from a variety of materials, including polymers, metals, composites, and fibrous materials, such as paperboard. It should be noted that the term "band" and the term "sheet" refer to the same structure and can be interchanged. However, the terms will be used in a manner that reflects a particular arrangement most accurately. In this regard, the band 30 shown in FIG. 3 is curled into a generally cylindrical form so that the opposing side edges 33, 35 are proximate one another. It is possible that the side edges 33, 35 may be in contact with one another, although preferably a small gap is present therebetween. The band 30 forms an inner diameter D3 and an outer diameter D4 that are sized according to the particular application.

For example, in one embodiment the inner diameter D3 of the band 30 is sized to be less than the outer diameter D2 of the core 12, such that when the band is stretched or biased about the core, the side edges 33, 35 spread slightly and an interference or frictional fit is formed between the band and core. In this example, the identification device 40 is interposed between the inner surface 36 of the band 30 and the outer surface 20 of the core 12 and is held in place by the interference fit. In another example, the outer diameter D4 of the band 30 is sized to be slightly more than the inner diameter D1 of the core 12, such that when the band is compressed or biased within the core, the side edges 33, 35 draw nearer one another and an interference fit is formed between the band and the core. In this example, the identification device 40 is interposed between the outer surface 38 of the band 30 and the inner surface 18 of the core 12 and held in place by the interference fit. In each example, the band 30 (and preferably the identification device 40) can be inserted into or about the core 12 at any position along the length of the core, yet still be removed from the core 12 and reused in other applications. The band 30 may also be color-coded or include text to more easily identify the particular products, core, customer, or other such information.

The identification device 40 is preferably a radio frequency identification (RFID) device that is capable of storing and transmitting data associated with the tubular structure 10, the products 11 stored in or on the structure, or both. Examples of such data and other data that can be stored, transmitted to and from, and deleted from the identification device 40 includes product ID, technical data, quality control information, code dating, location, and order status. Information can also be deleted, which includes overwriting, erasing, substituting, and disabling, so that the identification device 40 can be re-used for additional products or goods.

These types of features allow for improved inventory management, inventory control, in-house product location, and supply chain management.

The identification device 40 can have many shapes and configurations, but according to one embodiment the device is relatively thin and flat, and includes a coiled antenna and a capacitor that respond to magnetic fields, such as presented by radio frequency transmitters. Such RFID devices or tags are known and available from a variety of manufacturers, such as Motorola® and Texas Instruments®. The coiled antenna of the identification device 40 is typically made from metal, although printed carbon-based materials may also be used. As discussed above, the location of the identification device 40 is determined by the location of the flexible band or sheet 30, although preferably the identification device 40 is located near one of the ends 14, 16 of the core 12 so that it can be easily removed and be in more direct proximity to surrounding electronic transmitters.

Figure 4:
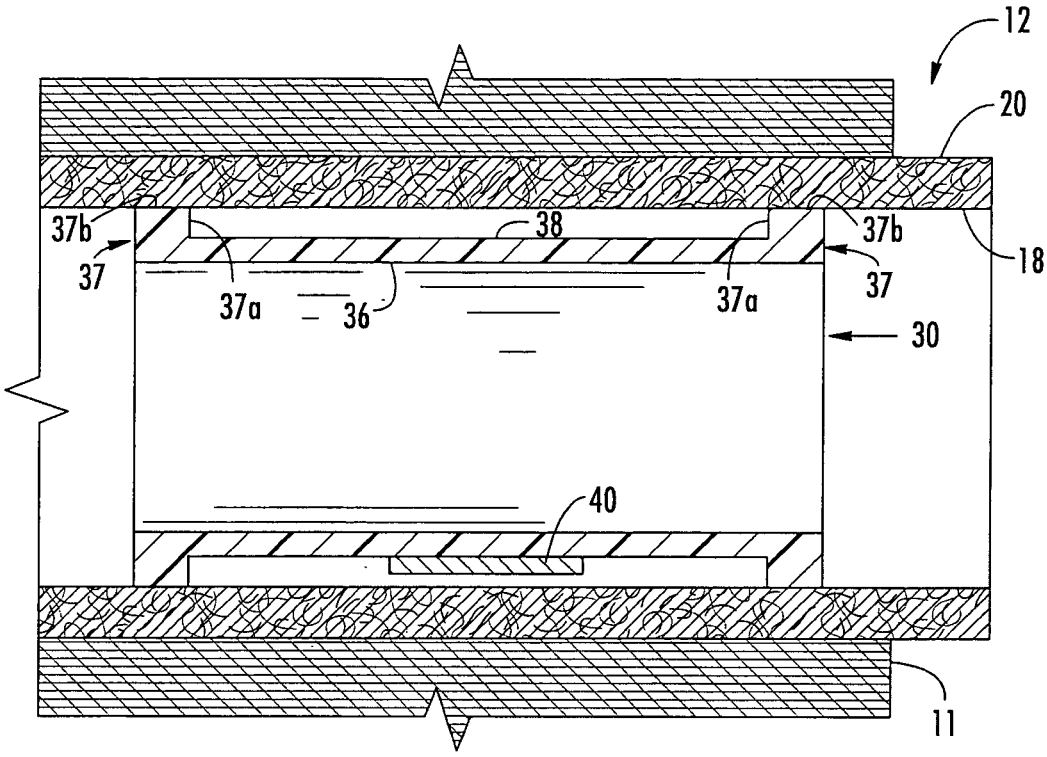
FIG. 4 is a cross-sectional view of an alternative arrangement for a flexible band according to one embodiment of the present invention.
Figure 5:
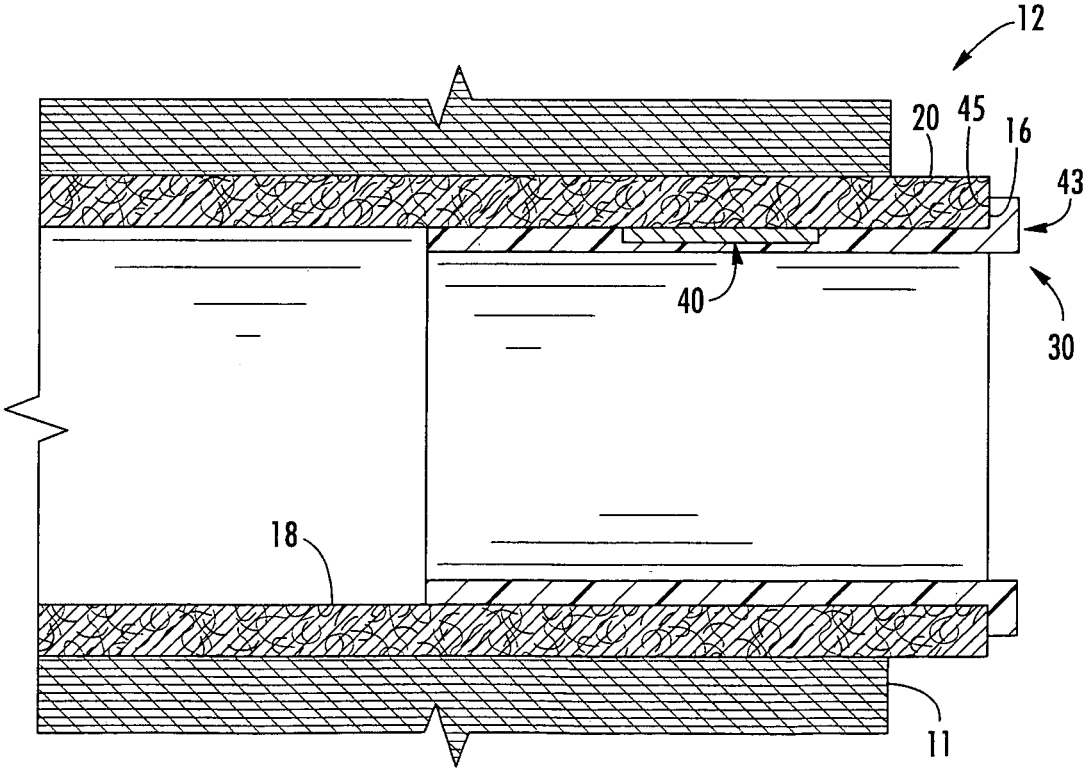
FIG. 5 is a cross-sectional view of another alternative arrangement for a flexible band according to one embodiment of the present invention.

FIGS. 4 and 5 illustrate alternative arrangements between the core 12, band 30, and identification device 40. In particular, FIG. 4 shows one embodiment of the band 30 whereby the band includes opposing flanges 37 at the ends 32, 34 thereof. The flanges 37 include sides 37*a* and 37*b*, which are shown as being approximately perpendicular to one another, although the angle formed by the sides can be different, including a more curved transition between the sides. The sides 37*b*, however, form the interference fit between the band 30 and the inner surface 18 of the core 12, so enough surface area of the sides 37*b* must be presented as well as sufficient diameter of the band 30 in order to accomplish sufficient friction. The sides 37 define the outer surface 38 of the band 30 as a relief or recess, and the identification device 40 is positioned in the recess and is held between the sides 37. Depending on the depth of the recess and the thickness of the identification device 40, the identification device may be free to move freely about the recess.

FIG. 5 shows another embodiment of the band 30 whereby the band includes a flange 43 that includes surface 45 that fits against one end 16 of the core 12 and prevents further insertion of the band 30 into the core. Preferably, the surface 45 extends radially no greater than the outer surface 20 of the core 12 and is flush therewith, although the surface 45 may extend greater or less than the outer surface of the core, depending on the needs and circumstances. Advantageously, the flange 43 may include color and/or text so that information can be easily seen. In addition, the flange 43 assists in easy removal of the band 30 from the core 12, as well as indicating that the core 12 has a band 30 already inserted therein. As described generally above, the identification device 40 is interposed between the band 30 and the inner surface 18 of the core 12 and is held by the interference fit between the band and the core.

Figure 6:
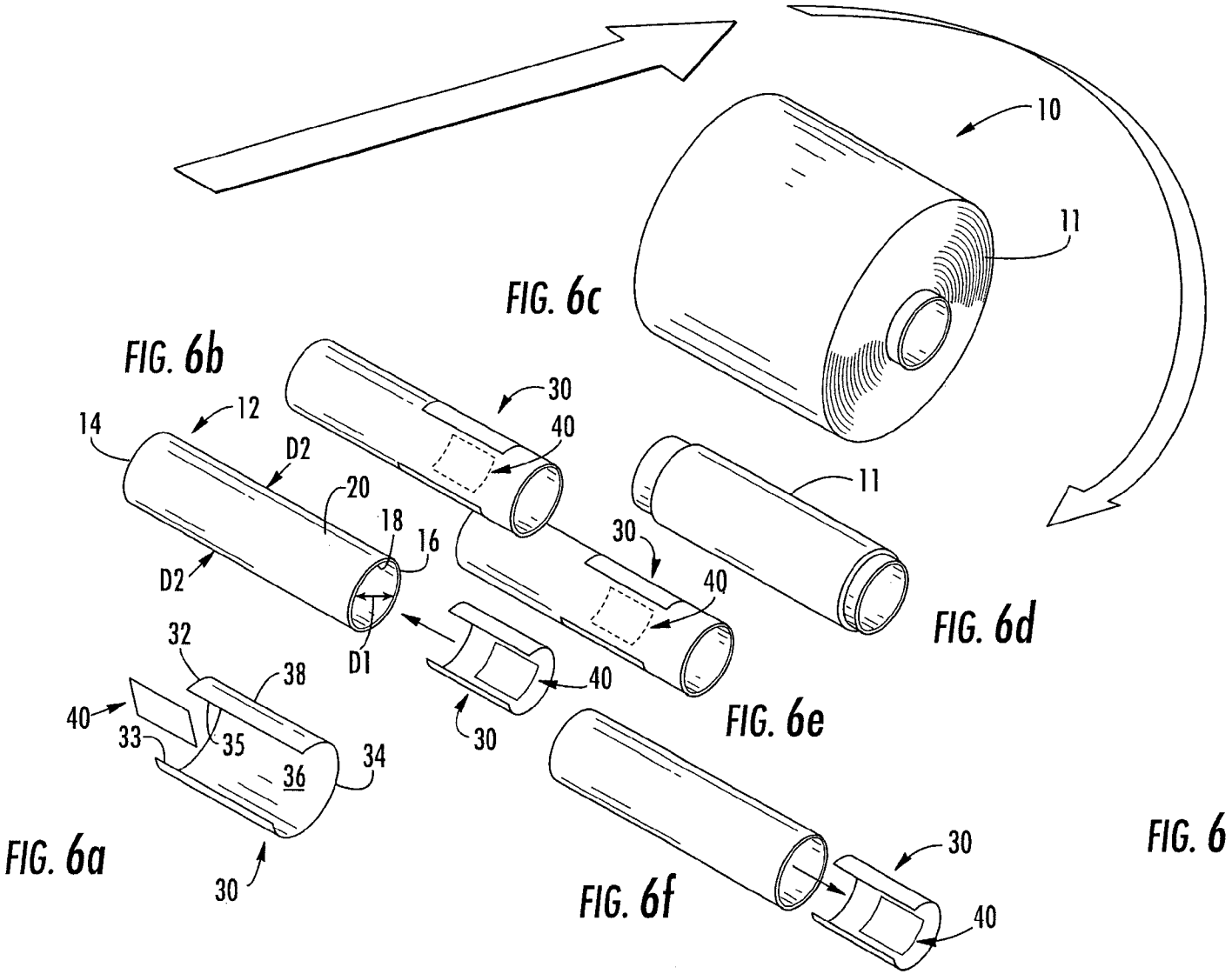
FIGS. 6–10 are process diagrams of using a tubular structure according to the present invention.

FIGS. 6–10 illustrate various methods of installing the band 30 and identification device 40 in conjunction with the tubular structure 10 of the present invention. In addition, FIGS. 6–10 illustrate how the core 12, band 30, and identification device 40 can be recycled or reused for future applications. Referring specifically to FIG. 6, step 6A includes attaching or placing the identification device 40 to the band 30, such as by positioning the identification device against the inside surface 36 of the band. Step 6B includes positioning the band 30 and identification device 40 about the outer surface 20 of the core 12 such that the identification device is interposed between the band and the core. Step 6C includes winding the material or product 11 about core 12 and over the band 30. Step 6D includes using the product 11 or otherwise removing a majority of the product. If any leftover product remains, step 6E includes removing the excess or leftover product 11 so that the band 30 is exposed. Step 6F includes sliding or otherwise removing the band 30 and identification device 40 from the core 12, whereafter the core may be repulped or recycled, and the band 30 and identification device 40 may be reused in future applications. During the steps of FIG. 6, information can be stored, transferred, and deleted from the identification device 40 as is known in the art. Advantageously, the band 30 protects the identification device 40 from damage and abuse during the process steps and transportation. This is particularly advantageous when the leftover material or product is removed, as typically the removal is performed by cutting the material from the core 12 using a knife, which could damage the identification device 40 if not for the band 30.

Figures 7, 7A, 7B, 7C, 7D, 7E, 7F:
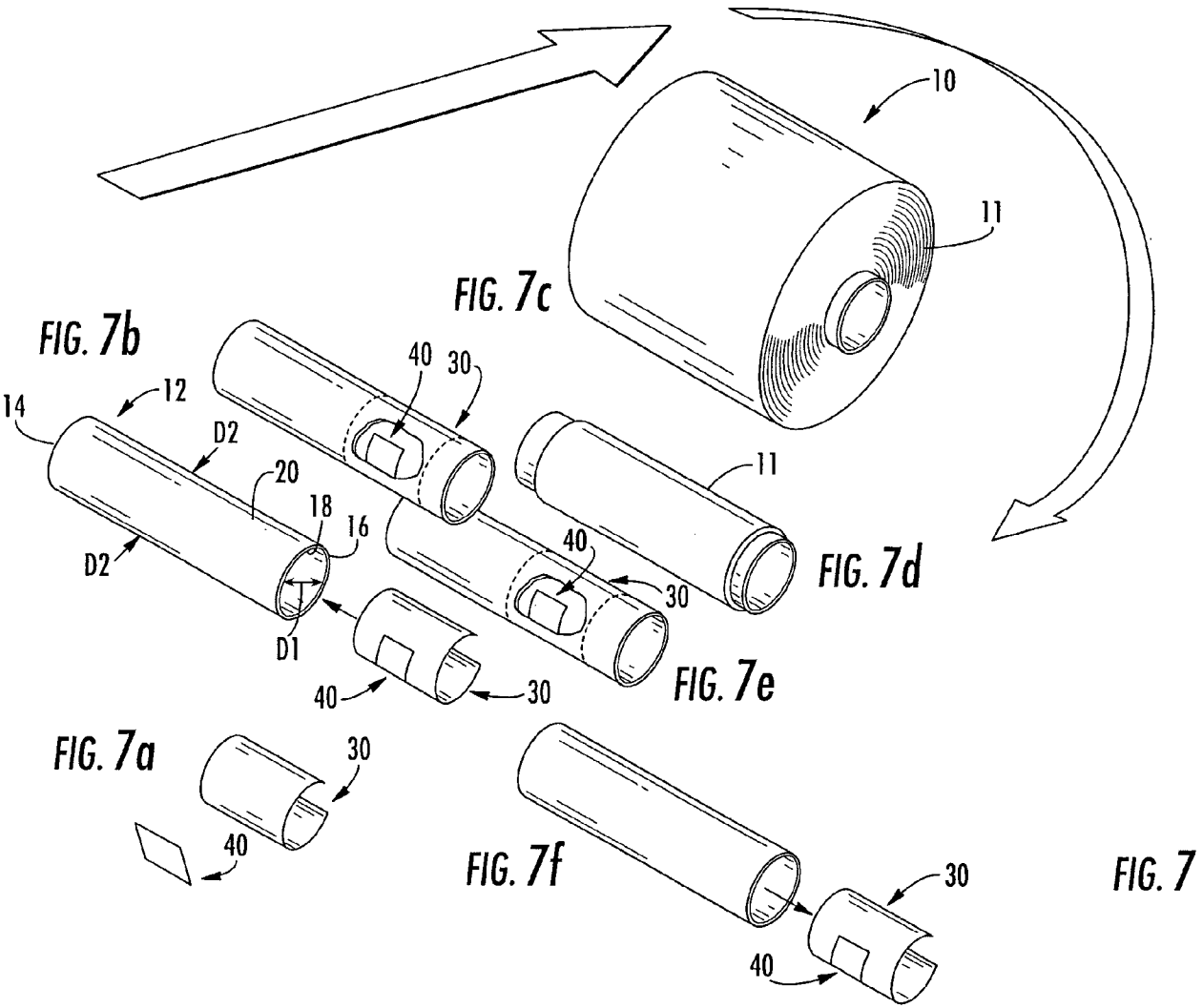

FIG. 7 illustrates another method according to the present invention, wherein FIG. 7A includes attaching or positioning the identification device 40 to the outer surface 38 of the band 30. Step 7B includes positioning the band 30 and the identification device 40 inside the core 12 such that the identification device is interposed between the outer surface 38 of the band 30 and the inner surface 18 of the core 12. Step 7C includes winding the material or product 11 about core 12. Step 7D includes using the product 11 as described above, which depletes the product remaining on the core 12. Step 7E includes removing the excess or leftover product 11, and step 7F includes sliding or otherwise removing the band 30 and identification device 40 from the core 12 in order to facilitate reuse and/or recycling.

Figures 8, 8A, 8B, 8C, 8D, 8E, 8F:
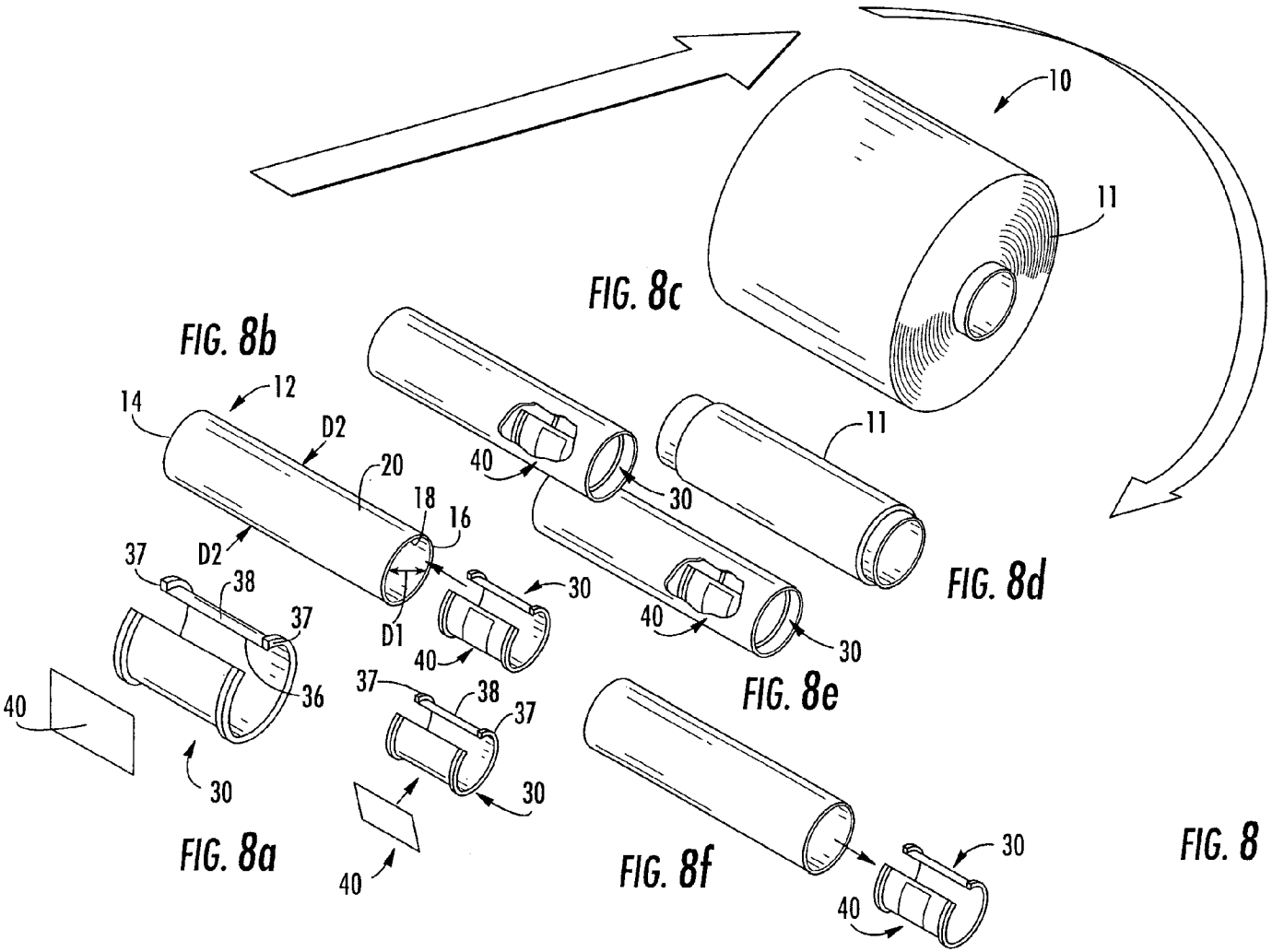
Figure 9:
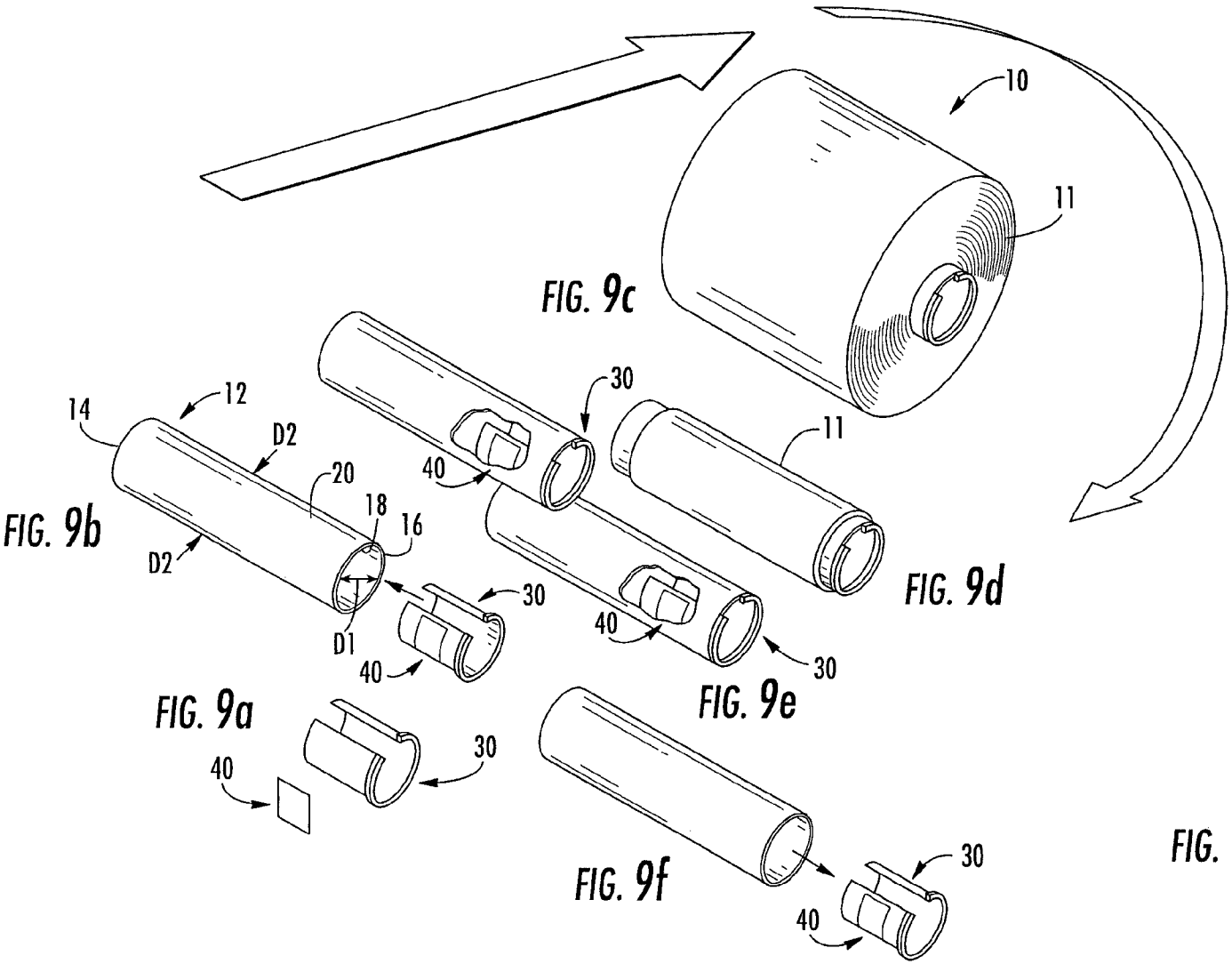

FIG. 8 illustrates another embodiment according to the present invention, wherein steps 8A–8F are performed in a manner described above for FIG. 7, but in this embodiment the band 30 includes the opposing flanges 37 so that the identification device 40 is located in the recess defined by the outer surface 38 and the flanges 37 of the band. Similarly, FIG. 9 illustrates another embodiment of the present invention, wherein steps 9A–9F are performed in a manner described above for FIG. 7, but in this embodiment the band 30 includes the flange 43 that registers with the end 16 of the core 12 as described above wherein the identification device 40 is interposed between the band 30 and the inner surface 18 of the core 12.

Figures 10, 10A, 10B, 10C, 10D, 10E, 10F:
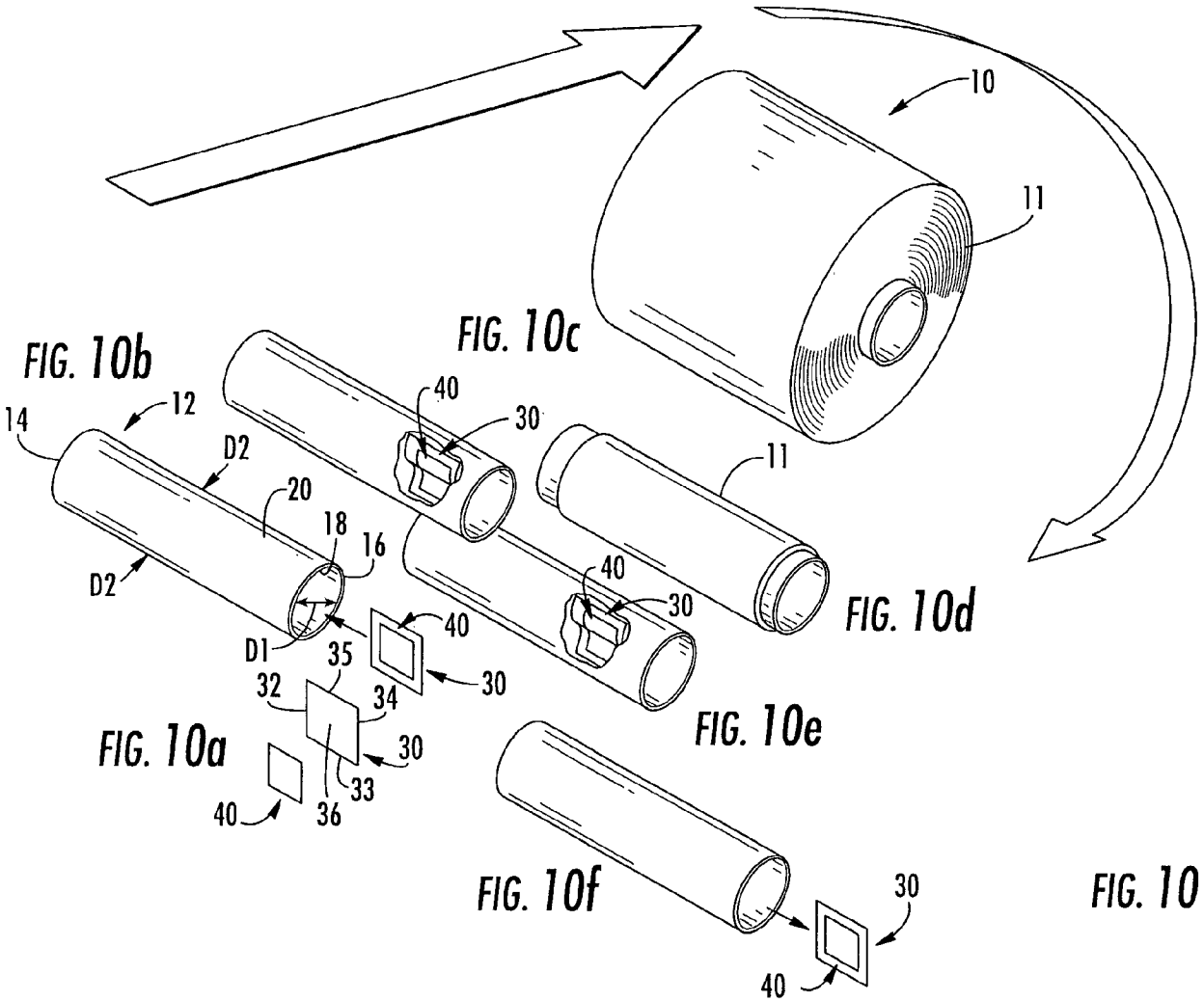

FIG. 10 illustrates yet another embodiment of the present invention. While most of the steps 10A–10F are similar to the steps of FIGS. 6–9, the identification device 40 in this embodiment is attached to a resiliently flexible sheet 30 that has opposing ends 32, 34 and side edges 33, 35. The distance between the side edges 33, 35 of the sheet 30 is greater than the inner diameter D1 of the core 12, so in order the position the sheet 30 inside the core, the sheet is biased, e.g., bowed, compressed, squeezed, or the like, so that the opposing side edges 33, 35 are biased against the inner surface 18 of the core 12 and releasably secured thereto by an interference fit. The natural tendency of the sheet 30 to straighten to an unbiased shape maintains the interference fit with the core 12. The identification device 40 is attached to one side 36 of the sheet 30, such as by adhesive or the like, and can be removed from the sheet at the end of the process cycle, as shown in step 10F.

Accordingly, the present invention provides an advantageous system for recording information about products and or structures relating thereto. The flexible sheet or band 30 provides protection to the identification device 40 while also being able to convey information itself by including color and/or text in the design of the band 30. The present invention limits the amount of waste by allowing the band and identification device to be recycled or reused for future applications, while the core 12 may be repulped or recycled independently. Because the lifespan of the core 12 is significantly less than that of the identification device 40 and band 30, the present invention reduces cost in the production of new cores. At the same time, the present invention allows for a new identification device to be associated with a core or products if the device were damaged instead of requiring the scrapping of the undamaged core.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tubular structure for storing products, comprising:

a tubular core having inner and outer surfaces and opposed ends, the outer surface defining an outer diameter of the tubular core;

a resiliently flexible band having opposing side edges, the flexible band being curled into a cylindrical form so that the opposing side edges are proximate one another, the flexible band having an inner diameter in a relaxed state that is sized to be less than the outer diameter of the tubular core, the flexible band being adapted to be biased about the outer surface of the tubular core and be secured thereto by a frictional fit therebetween; and a radio frequency identification device interposed between the resiliently flexible band and the tubular core.

2. A tubular structure according to claim 1, wherein the tubular core is formed from multiple layers of paperboard material wrapped one upon another about an axis of the tubular core and adhered together.

3. A tubular structure according to claim 1, wherein the identification device is capable of storing and transmitting data associated with at least one of the tubular structure and the products.

4. A tubular structure according to claim 1, wherein the identification device includes a coiled antenna and a capacitor.

5. A tubular structure according to claim 1, wherein the identification device includes a printed carbon-based antenna.

6. A tubular structure according to claim 1, wherein the flexible band has a unique identifier selected from the group consisting of text and color.

7. A tubular structure according to claim 1, wherein the flexible band is formed from at least one material of a group consisting of polymers, metals, composites, and paperboard.

8. A tubular structure for storing products, comprising:

a tubular core having inner and outer surfaces and opposed ends, the inner surface defining an inner diameter of the core;

a resiliently flexible band having opposing ends and side edges, the flexible band being curled into a cylindrical form so that the opposing side edges are proximate one another, the flexible band having an outer diameter in a relaxed state that is sized to be greater than the inner diameter of the tubular core, the flexible band being adapted to be flexibly positioned against the inner surface of the tubular core and be secured thereto by an interference fit therebetween; and a radio frequency identification device capable of storing and transmitting data associated with at least one of the tubular core and the products, the identification device being interposed between the resiliently flexible band and the tubular core.

9. A tubular structure according to claim 8, wherein the tubular core is formed from multiple layers of paperboard material wrapped one upon another about an axis of the tubular core and adhered together.

10. A tubular structure according to claim 8, wherein the identification device includes a coiled antenna and a capacitor.

11. A tubular structure according to claim 8, wherein the identification device includes a printed carbon-based antenna.

12. A tubular structure according to claim 8, wherein the flexible band has a unique identifier selected from the group consisting of text and color.

13. A tubular structure according to claim 8, wherein the flexible band is formed from at least one material of a group consisting of polymers, metals, composites, and paperboard.

14. A tubular structure according to claim 8, wherein the flexible band defines a cavity between the opposing ends thereof, and wherein the identification device is positioned in the cavity.

15. A tubular structure according to claim 8, wherein the flexible band includes a flange at one of the opposing ends, the flange adapted for registering against one of the opposed ends of the tubular core.

16. A tubular structure for storing products, comprising:

a tubular core having inner and outer surfaces and opposed ends, the inner surface defining an inner diameter of the tubular core; and a resiliently flexible sheet having opposing ends and side edges positioned in the tubular core and in contact with the inner surface thereof, the flexible sheet defining a distance between the opposing side edges that is greater than the inner diameter of the tubular core so that the flexible sheet is biased against the inner surface of the tubular core and releasably secured thereto by an interference fit therebetween, the flexible sheet having a radio frequency identification device attached thereto capable of storing and transmitting data associated with at least one of the tubular core and the products.

17. A tubular structure according to claim 16, wherein the tubular core is formed from multiple layers of paperboard material wrapped one upon another about an axis of the tubular core and adhered together.

18. A tubular structure according to claim 16, wherein the identification device includes a coiled antenna and a capacitor.

19. A tubular structure according to claim 16, wherein the identification device includes a printed carbon-based antenna.

20. A tubular structure according to claim 16, wherein the flexible sheet is formed from at least one material of a group consisting of polymers, metals, composites, and paperboard.

21. A method of manufacturing a tubular structure for storing products, the method comprising:

providing a tubular core having inner and outer surfaces and opposed ends; and releasably securing a resiliently flexible band having opposing side edges and a radio frequency identification device in contact therewith to the tubular core by biasing the resiliently flexible band so that the flexible band and the tubular core form an interference fit therebetween.

22. A method according to claim 21, wherein the securing step includes biasing the resiliently flexible band about the outer surface of the tubular core so that the identification device is interposed between the flexible band and the outer surface of the tubular core.

23. A method according to claim 21, wherein the securing step includes biasing the resiliently flexible band against the inner surface of the tubular core so that the identification device is interposed between the flexible band and the inner surface of the tubular core.

24. A method according to claim 21, wherein the securing step includes biasing the resiliently flexible band against the inner surface of the tubular core so that the opposing side edges are in contact with the inner surface of the tubular core, the flexible band having the identification device attached thereto.

25. A method according to claim 21, further comprising winding products about the tubular core and storing information about the products in the identification device.

26. A method according to claim 25, further comprising using the products wound on the tubular core, and removing the flexible band and identification device from the tubular core.

* * * * *